US009019118B2

(12) United States Patent
Milne et al.

(10) Patent No.: US 9,019,118 B2
(45) Date of Patent: Apr. 28, 2015

(54) AUTOMATED WELL CONTROL METHOD AND APPARATUS

(75) Inventors: Eric L. Milne, Pearland, TX (US); Joseph P. Ebenezer, Spring, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 702 days.

(21) Appl. No.: 13/328,486

(22) Filed: Dec. 16, 2011

(65) Prior Publication Data

US 2012/0274475 A1 Nov. 1, 2012

Related U.S. Application Data

(60) Provisional application No. 61/479,203, filed on Apr. 26, 2011.

(51) Int. Cl.

| | |
|---|---|
| ***G01V 3/00*** | (2006.01) |
| ***E21B 47/10*** | (2012.01) |
| ***E21B 21/08*** | (2006.01) |

(52) U.S. Cl.

CPC ..... *E21B 47/10* (2013.01); *E21B 21/08* (2013.01)

(58) Field of Classification Search

CPC ..... E21B 44/00; E21B 21/08; E21B 47/0001; E21B 44/005

USPC ..... 340/853.2, 853.3; 175/5, 57, 25; 702/6

See application file for complete search history.

(56) References Cited

U.S. PATENT DOCUMENTS

| | | | | |
|---|---|---|---|---|
| 3,552,502 | A | 1/1971 | Wilson, Sr. | |
| 4,440,239 | A * | 4/1984 | Evans | 175/5 |
| 4,492,865 | A | 1/1985 | Murphy et al. | |
| 4,715,451 | A | 12/1987 | Bseisu et al. | |
| 4,760,735 | A | 8/1988 | Sheppard et al. | |
| 4,840,061 | A | 6/1989 | Peltier | |
| 4,862,426 | A | 8/1989 | Cassity et al. | |
| 5,347,859 | A | 9/1994 | Henneuse et al. | |
| 5,952,569 | A | 9/1999 | Jervis et al. | |
| 6,123,561 | A | 9/2000 | Turner et al. | |
| 6,343,654 | B1 | 2/2002 | Brammer | |
| 6,820,702 | B2 * | 11/2004 | Niedermayr et al. | 175/57 |
| 6,868,920 | B2 * | 3/2005 | Hoteit et al. | 175/25 |

(Continued)

FOREIGN PATENT DOCUMENTS

| | | |
|---|---|---|
| EP | 1793079 A2 | 6/2007 |
| WO | WO/2005/065364 | 1/2005 |
| WO | WO/2009/123462 | 8/2009 |

OTHER PUBLICATIONS

European Search Report and Written Opinion issued in connection with corresponding EP Application No. 12165387.7-1610 dated Sep. 30, 2014.

*Primary Examiner* — Albert Wong

(74) *Attorney, Agent, or Firm* — Bracewell & Giuliani LLP

(57) ABSTRACT

A drilling control system monitors and compares drilling and completion operation sensor values and autonomously acts in response to conditions such as a kick or surge. Sensors in various combinations may monitor return fluid flow rate, fluid inflow rate, wellhead bore pressure, temperature of returning fluid, torque, rate of penetration and string weight change. The control system has corresponding control logic to monitor, warn and act based on the sensor inputs. The actions may include the warning of support personnel, closing an annular blowout preventer, shearing drill pipe using a ram shear, pumping heavier fluid down choke and kill lines, disconnecting the riser or various other actions.

20 Claims, 2 Drawing Sheets

(56) References Cited

U.S. PATENT DOCUMENTS

| | | | | |
|---|---|---|---|---|
| 7,281,587 | B2 | 10/2007 | Haugen | |
| 7,513,308 | B2 | 4/2009 | Hosie et al. | |
| 7,591,304 | B2 | 9/2009 | Juhasz et al. | |
| 7,757,759 | B2 | 7/2010 | Jahn et al. | |
| 2005/0222772 | A1* | 10/2005 | Koederitz et al. | 702/6 |
| 2008/0202810 | A1 | 8/2008 | Gomez | |
| 2010/0314100 | A1 | 12/2010 | Tepavac et al. | |

* cited by examiner

AUTOMATED WELL CONTROL METHOD AND APPARATUS

CROSS-REFERENCE TO RELATED APPLICATION

This application claims the benefit of U.S. Provisional Application No. 61/479,203 filed on Apr. 26, 2011.

FIELD OF THE INVENTION

This disclosure relates in general to offshore well drilling and in particular to an automated method for controlling a subsea well during drilling procedures.

BACKGROUND OF THE INVENTION

The future of oil and gas exploration lies in deep waters and greater depth under the seabed. This renders the subsea equipment to increasingly harsh conditions such as higher pressures and increased temperatures. These harsher conditions can cause an increase in the number of kicks and hence decrease the efficiency and safety of a given operation. This calls for designing a subsea automatic control system for this widened high pressure and high temperature envelope. A control system which is capable of monitoring and logically controlling the equipment and tools can lead to a more reliable, safer, and more efficient subsea operation.

An improved control system that provides a more reliable, safer, and more efficient subsea drilling operation is sought.

SUMMARY

The drilling system of this invention has features to automatically detect and control a kick or surge without requiring decisions to be made by operating personnel. The invention consists of sensors and an automatic control system that monitors and performs actions autonomously based on the sensor inputs. In a given embodiment there may exist a multitude of sensor combinations depending on the needs of the particular drilling operation. For example, in one embodiment there may exist a sensor to monitor return flow rate. The signals from the return flow rate sensor may be transmitted conventionally, such as through wires and fiber optic sensors that may be part of the umbilical leading to the platform. Ideally, the return flow rate sensor will indicate the flow rate at all times that exist within the wellhead assembly. An increase in flow rate sensed by the return flow rate sensor may indicate a kick. Additional sensor inputs such as inflow rate, temperature, wellhead bore pressure, string weight change, rate of penetration, torque, and various other sensors may all be monitored for additional indications of a kick or surge condition. Certain sets of sensor conditions may cause the control system to perform autonomous actions to lessen or stop the kick. For example, an indicated kick condition may cause the control system to alert operation personnel and subsequently initiate emergency procedures. These procedures may include an emergency disconnect sequence or the initiation of a wellbore shut-in sequence.

The foregoing and other objects and advantages of the present invention will be apparent to those skilled in the art, in view of the following detailed description of the present invention, taken in conjunction with the appended claims and the accompanying drawings.

DETAILED DESCRIPTION OF THE INVENTION

Figure 1:
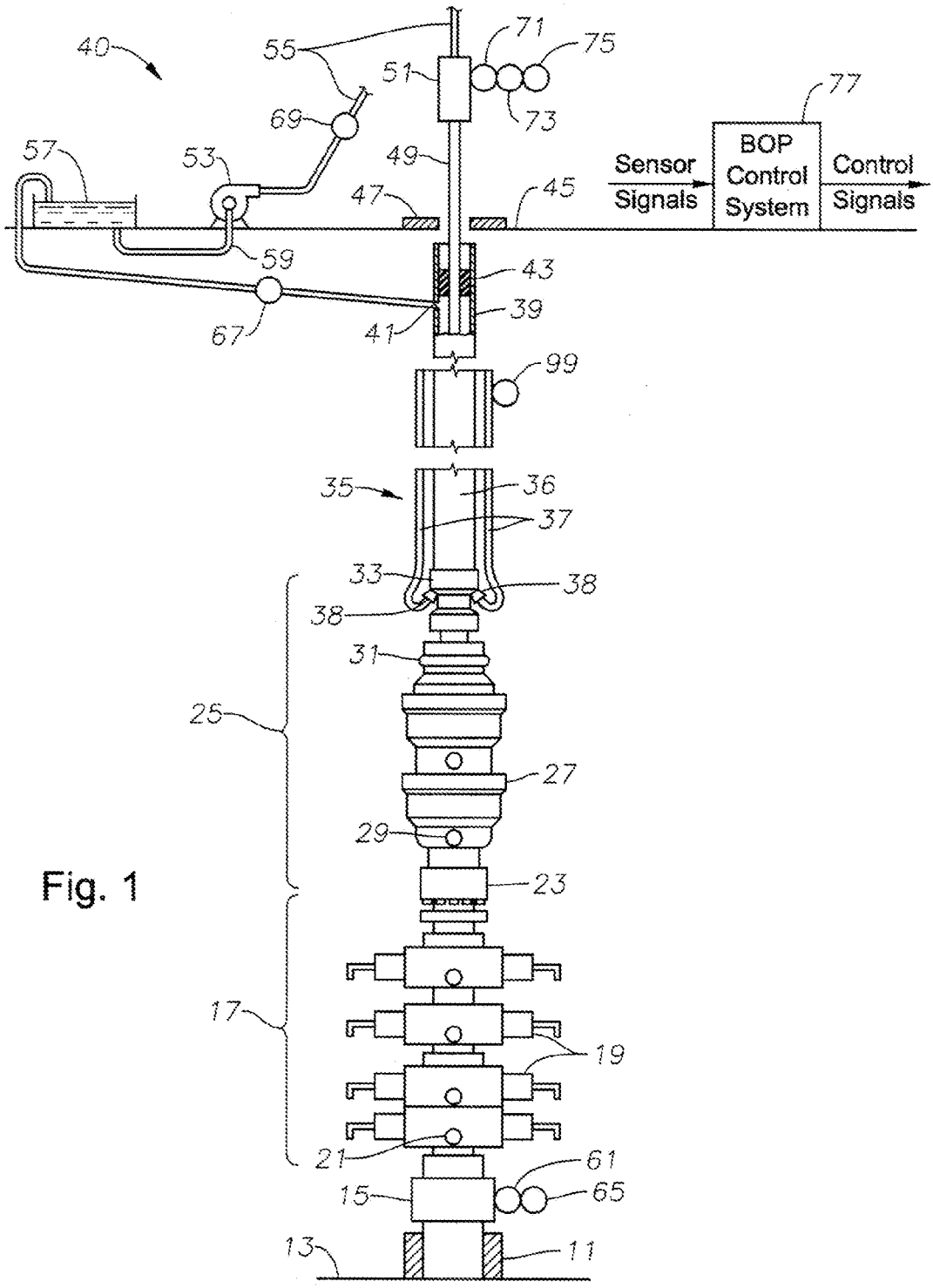
FIG. 1 is a schematic view illustrating a well drilling control system in accordance with this disclosure.

FIG. 1 illustrates a subsea well being drilled or completed. The well has been at least partially drilled, and has a subsea wellhead assembly 11 installed at sea floor 13. At least one string of casing (not shown) will be suspended in the well and supported by wellhead assembly 11. The well may have an open hole portion not yet cased, or it could be completely cased, but the completion of the well not yet finished.

A hydraulically actuated connector 15 releasably secures a blowout preventer (BOP) stack 17 to the wellhead housing assembly 11. BOP stack 17 has several ram preventers 19, some of which are pipe rams and at least one of which is a blind ram. The pipe rams have cavities sized to close around and seal against pipe extending downward through wellhead housing 11. The blind rams are capable of shearing the pipe and affecting a full closure. Each of the rams 19 has a port 21 located below the closure element for pumping fluid into or out of the well while the ram 19 is closed. The fluid flow is via choke and kill lines (not shown).

A hydraulically actuated connector 23 connects a lower riser marine package (LMRP) 25 to the upper end of BOP stack 17. Some of the elements of LMRP 25 include one or more annular BOP's 27 (two shown). Each annular BOP 27 has an elastomeric element that will close around pipes of any size. Also, BOP 27 can make full closure without a pipe extending through it. Each annular BOP 27 has a port 29 located below the elastomeric element for pumping fluid into or out of the well below the elastomeric element while BOP 27 is closed. The fluid flow through port 29 is handled by choke and kill lines. Annular BOP's 27 alternately could be a part of BOP stack 17, rather than being connected to BOP stack 17 with a hydraulically actuated connector 23.

LMRP 25 includes a flex joint 31 capable of pivotal movement relative to the common axis of LMRP 25 and BOP stack 17. A hydraulically actuated riser connector 33 is mounted above flex joint 31 for connecting to the lower end of a string of riser 35. Riser 35 is made up of joints of pipe 36 secured together. Auxiliary conduits 37 are spaced circumferentially around central pipe 36 of riser 35. Auxiliary conduits 37 are of smaller diameter than central pipe 36 of riser 35 and serve to communicate fluids. Some of the auxiliary conduits 37 serve as choke and kill lines. Others provide hydraulic fluid pressure. Flow ports 38 at the upper end of LMRP 25 connect certain ones of the auxiliary conduits 37 to the various actuators. When riser connector 33 disconnects from central riser pipe 36 and riser 35 is lifted, flow ports 38 will also be disconnect from the auxiliary conduits 37. At the upper end of riser 35, auxiliary conduits 37 are connected to hoses (not shown) that extend to various equipment on a floating drilling vessel or platform 40.

Electrical and optionally fiber optic lines extend downward within an umbilical to LMRP 25. The electrical, hydraulic, and fiber optic control lines lead to one or more control modules (not shown) mounted to LMRP 25. The control module controls the various actuators of BOP stack 17 and LMRP 25.

Riser 35 is supported in tension from platform 40 by hydraulic tensioners (not shown). The tensioners allow platform 40 to move a limited distance relative to riser 35 in response to waves, wind and current. Platform 40 has equipment at its upper end for delivering upwardly flowing fluid from central riser pipe 36. This equipment may include a flow diverter 39, which has an outlet 41 leading away from central riser pipe 39 to platform 40. Diverter 39 may be mounted to platform 40 for movement with platform 40. A telescoping joint (not shown) may be located between diverter 39 and riser 35 to accommodate this movement. Diverter 39 has a hydraulically actuated seal 43 that when closed, forces all of the upward flowing fluid in central riser pipe 36 out outlet 41.

Platform 40 has a rig floor 45 with a rotary table 47 through which pipe is lowered into riser 35 and into the well. In this example, the pipe is illustrated as a string of drill pipe 49, but it could alternately comprise other well pipe, such as liner pipe or casing. Drill pipe 49 is shown connected to a top drive 51, which supports the weight of drill pipe 49 as well as supplies torque. Top drive 51 is lifted by a set of blocks (not shown), and moves up and down a derrick while in engagement with a torque transfer rail. Alternately, drill pipe 49 could be supported by the blocks and rotated by rotary table 47 via slips (not shown) that wedge drill pipe 49 into rotating engagement with rotary table 47.

Mud pumps 53 (only one illustrated) mounted on platform 40 pump fluids down drill pipe 49. During drilling, the fluid will normally be drilling mud. Mud pumps 53 are connected to a line leading to a mud hose 55 that extends up the derrick and into the upper end of top drive 51. Mud pumps 53 draw the mud from mud tanks 57 (only one illustrated) via intake lines 59. Riser outlet 41 is connected via a hose (not shown) to mud tanks 57. Cuttings from the earth boring occurring are separated from the drilling mud by shale shakers (not shown) before reaching mud pump intake lines 59.

A kick, defined as an unscheduled entry of formation fluids into the wellbore, may occur while drilling or while completing a well. Basically, the kick occurs when an earth formation has a higher pressure than the hydrostatic pressure of the fluid in the well. If the well has an uncased or open hole portion, the hydrostatic pressure acting on the earth formation is that of the drilling mud. Operating personnel control the weight of the drilling mud so that it will provide enough hydrostatic pressure to avoid a kick. However, if the mud weight is excessive, it can flow into the earth formation, damaging the formation and causing lost circulation. Consequently, operating personnel balance the weight so as to provide sufficient weight to prevent a kick but avoid fluid loss.

A kick may occur while drilling, while tripping the drill pipe 49 out of the well or running the drill pipe 49 into the well. A kick may also occur while lowering logging instruments on wire line into the well to measure the earth formation. A kick may occur even after the well has been cased, such as by a leak through or around the casing or between a liner top and casing. In that instance, the fluid in the well may be water, instead of drilling mud. If not mitigated, a kick can result in high pressure hydrocarbon flowing to the surface; possibly pushing the drilling mud and any pipe in the well upward. The hydrocarbon may be gas, which can inadvertently be ignited.

Normally, kicks are controlled by personnel at platform 40 detecting the kick in advance and taking remedial action. A variety of techniques are used by personnel based on experience to detect a kick. Also, a variety of remedial actions are taken. For example, detecting that more drilling mud is returning than being pumped in may indicate a kick. The remedial action may include closing the annular BOP 27 and pumping heavier fluid down the choke and kill lines to port 21, which directs the heavier fluid into the well. If drilling mud continues to flow up riser 35 and out outlet 41, the operating personnel may close diverter 39 and direct the flow to a remote flare line. If remedial actions are not working, the operating personnel can close rams 19 and shear drill pipe 49, then disconnect riser 35, such as at connector 23 or connector 33. Platform 40 can then be moved, bringing riser 35 along with it. The detection and remedial steps require decisions to be made by operating personnel on platform 40.

The drilling system shown in FIG. 1 has features to automatically detect and control a kick without requiring decisions to be made by operating personnel. The drilling system of FIG. 1 has many sensors, of which only a few are illustrated. The sensors are intended to provide an early detection of a kick, and more or fewer may be used. Some of the sensors may be helpful only during drilling, but not while tripping the drill pipe or performing other operations, such as cementing.

A return flow rate sensor 67 will sense the flow rate of the drilling mud returning, or the flow rate of any upward flowing fluid. Return flow rate sensor 67 may be located in outlet 41 as shown or in BOP stack connector 15. An inflow sensor 69 may be located at the outlet of mud pumps 53 to determine the flow rate of fluid being pumped into the well. If the return flow rate sensed by sensor 67 is greater than the inflow rate sensed by sensor 69, an indication exists that a kick is occurring. If the return flow rate is less than the inflow rate, an indication exists that fluid losses into the earth formation are occurring. Differences in flow rates between sensors 67, 69 can occur because of other factors, however. For example, some lost circulation may be occurring in one earth formation at the same time a kick from another formation is occurring.

A wellhead bore pressure sensor 61 will preferably be located just above wellhead assembly 11 within BOP stack 17 below the lowest ram 19. The signals from wellhead bore pressure sensor 61 are transmitted conventionally, such as through wires and fiber optic sensors that may be part of the umbilical leading to platform 40. Wellhead bore pressure sensor 61 will indicate the pressure at all times that exist within wellhead assembly 11. While circulating drilling mud down through drill pipe 49, the pressure sensed will be the pressure of the returning drilling mud outside of drill pipe 49 at that point. That pressure depends on the hydrostatic pressure of the drilling mud above sensor 61, which is proportional to the sea depth. If drilling mud is not being circulated, the pressure sensed will be the hydrostatic pressure of the fluid in riser central pipe 36. An increase in pressure sensed by sensor 61 may indicate a kick. However, a kick might be occurring even though sensor 61 is sensing only a normal range of pressure. For example, gas migration up riser 35 would lighten the column of drilling mud above sensor 61, causing it to either not show an increase in pressure or show a drop in pressure. Also, the pressure monitored by sensor 61 is affected by the pressure of mud pumps 53. Nevertheless, when coupled with other parameters being sensed, sensor 61 provides valuable information that may indicate a kick.

Preferably one or more temperature sensors 65 is employed to sense a temperature of the upward flowing fluid. Temperature sensor 65 is also preferably in wellhead connector 15 for sensing the temperature of fluid in the bore of wellhead assembly 11. The temperature may change if a kick is occurring. When combined with other data concerning the upward flowing fluid in riser 35, an indication of a kick may be determined with accuracy.

A string weight sensor 71 is mounted to top drive 51, or to the blocks, for sensing the weight of the pipe string being supported by the derrick. During drilling, the weight of drill pipe 49 sensed depends on how much weight of the drill pipe 49 is applied to the drill bit. If the operating personnel applies more brake, the weight sensed will increase since less weight is being transferred to the bit. If the operating personnel releases some of the brake, more weight is applied to the bit, and sensor 71 senses less weight. If a kick of sufficient magnitude occurs to begin pushing up drill pipe 49, the weight sensed will decrease.

Linking the signal from string weight sensor 71 to a rate of penetration (ROP) sensor 73 will assist in determining whether less weight being sensed is due to more brake being applied or to a kick. ROP sensor 73 measures how fast drill pipe 49 is moving downward, thus is an indication of the amount of brake being applied. ROP sensor 73 also will determine when a very soft formation is being drilled into, suggesting that lost circulation might be occurring.

In addition a torque sensor 75 provides useful information concerning kicks. Torque sensor 75 is mounted at or near top drive and senses the amount of torque being imposed during drilling. If a kick is tending to lift drill pipe 49, the torque would drop. Torque also decreases for other reasons, such as reducing the weight deliberately on the bit or encountering a soft formation. When coupled with the other data, torque sensed by torque sensor 75 during drilling can assist in an accurate prediction of the early occurrence of a kick.

A BOP control system 77 on platform 40 receives signals from sensors 61,65,67,69, 71, 73 and 75 and possibly others. BOP control system 77 processes these signals to detect whether a kick is occurring and issues control signals in response. Also, drill pipe 49 may have downhole sensing devices that determine conditions such as weight on the bit, torque on the bit, pressure of the drilling mud at the bit and the temperature of the drilling mud at the bit. Signals from these sensors may be transmitted up the well via mud pulse or other known techniques. These signals may also be fed to BOP control system 77.

Figure 2:
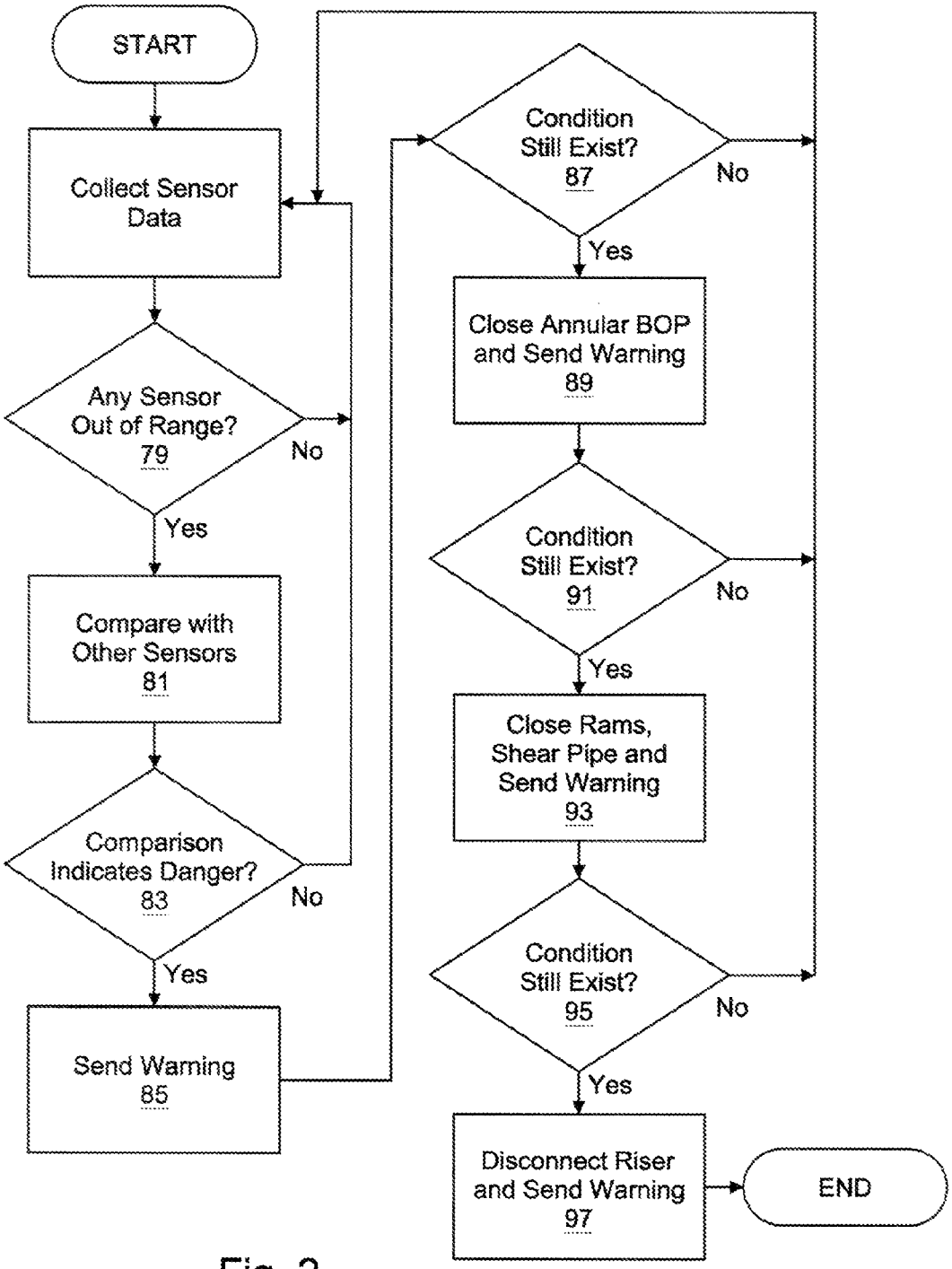
FIG. 2 is a schematic flow chart identifying steps employed by the control system of FIG. 1.

Referring to FIG. 2, data from the various sensors is supplied to a processor of BOP control system 77. Step 79 indicates that the processor determines if any of the sensors 69, 67, 65, 61, 71, 73 and 75 are outside of a normal preset range. If so, in step 81 it will then compare the out-of-range sensor with the data received from other sensors. For example, if the out-flow rate of sensor 67 exceeded the inflow rate of sensor 69 beyond an acceptable range, control system 77 will look at the data from the other sensors to determine if an explanation exists, pursuant to step 83. Perhaps, the other sensors will confirm that a problem exists or provide data that indicates a reasonable explanation. If the explanation is reasonable, control system 77 might take no action, depending upon how it is programmed.

If the various comparisons indicate a kick is occurring, control system 77 may be programmed to initially provide a visual and optionally audible warning to operating personnel, as indicated by step 85. Operating personnel may then attempt to remedy the problem, such as by closing the annular BOP 27. Control system 77, however, will continue to monitor the data sent by the sensors, as indicated by step 87. If it determines after a selected time interval that the kick condition still exists, it will move to a second warning or another step. The other step may be a first step in initiating an emergency disconnect sequence. That step depends upon the programming of control system 77. It could be closing the annular BOP 27 per step 89, if such hasn't already been done by the operating personnel. Control system 89 would also send a warning to the operating personnel that it has closed the annular BOP 27. That warning would enable the operating personnel to begin pumping drilling mud down the choke and kills lines into the well, preferably with a heavier drilling mud.

Regardless of what steps the operating personnel take, if any, control system 77 will continue to monitor the sensors, process the data and determine whether the dangerous condition still exists, as indicated in step 91. If after a selected interval, the dangerous condition is not abating, control system 77 will take another step 93 toward an emergency disconnect. Step 93 could be to close rams 19 and shear drill pipe 49, or it could be an interim step. Control system 77 would provide a warning to operating personnel that such has occurred. Control system 77 may continue to monitor the sensors, as per step 95. If the condition still exists after step 93, for whatever reason, control system 77 may then actuate either connector 23 or 33 to release riser 35 from wellhead assembly 11. BOP stack 17 remains connected to subsea wellhead assembly 11. The operating personnel would then proceed to move platform 40 from its station, bringing riser 35 along with it.

The automated mechanism for the initiation of an emergency disconnect sequence can also be applied and employed to the initiation of a wellbore shut-in sequence. That step depends upon the programming of control system 77. It could be closing the annular BOP 27 per step 89, if such hasn't already been done by the operating personnel. Control system 89 would also send a warning to the operating personnel that it has closed the annular BOP 27. That warning would enable the operating personnel to begin pumping drilling mud down the choke and kills lines into the well, preferably with a heavier drilling mud. Regardless of what steps the operating personnel take, if any, control system 77 will continue to monitor the sensors, process the data and determine whether the dangerous condition still exists, as indicated in step 91. If after a selected interval, the dangerous condition is not abating, control system 77 will take another step and open the inner and outer bleed valves, signaling the shut-in completion of the wellbore.

The control system can also track the existing stack configuration mode that the control system is currently being used in and continuously monitor signals from sensors 61,65, 67,69, 71, 73 and 75 and possibly others. Depending on the stack configuration mode, the control system can alert the operating personnel with confirmation to proceed with the existing stack condition or change the stack configuration mode to ensure that the BOP stack is brought to a safe mode. After a stipulated time interval, if there is no confirmation from the operating personnel, based on the current conditions of the stack and the functions involved, the emergency disconnect sequence or the well shut-in sequence is initiated.

Although not necessarily related to kicks, a riser inclination sensor 99 (FIG. 1) provides information of a serious problem. Riser 35 will incline when platform 40 moves from directly above wellhead assembly 11. Platform 40 typically has thrusters that are linked to a global positioning system (GPS). The GPS receives satellite signals and controls the thrusters to maintain platform 40 on the desired station. Sometimes the satellite signal is interrupted or a malfunction of the GPS occurs. If not detected timely, platform 40 might drift off station too far. Riser 35 has a maximum angle that it can achieve and still be disconnected at connector 23 or 33. Beyond that angle, connectors 23 or 33 would not be able to disconnect riser 35, thus damage to riser 35 would likely occur.

Signals from riser inclination sensor 99 can be fed to BOP control system 77, which determines if the inclination is out of a selected range. If so, BOP control system 77 can proceed through the same steps as illustrated in FIG. 2, eventually disconnecting riser 35, if necessary.

The invention claimed is:

1. An apparatus providing for automatic detection and control of a kick during subsea well drilling and completion operations with a rig connected to a subsea wellhead assembly via a riser and blowout preventer (BOP), the BOP having a riser disconnect, the apparatus comprising:

a plurality of sensors adapted to be coupled to a wellhead assembly for producing current sensor values of a well undergoing operations;

a control system having a processor containing a database of known sensor values indicative of a kick event, the processor having means for receiving and the current sensor values from the sensors and comparing the current sensor values against the known sensor values;

the control system having an automated warning component that alerts operations personnel if the comparison indicates a kick event;

the control system being linked to the BOP to automatically close the BOP if the kick event is still occurring after a selected time period; and the control system being linked to the riser disconnect to automatically begin steps to actuate the riser disconnect if the kick event is still occurring after the BOP has been closed for a selected time period.

2. The apparatus according to claim 1, wherein the control system further comprises:

a link to shear rams in the BOP to automatically close the shear rams to shear a string of drill pipe to actuating the riser disconnect in the event the kick is still occurring after the BOP has been closed a a selected time period.

3. The apparatus according to claim 1, wherein at least one of the sensors comprises:

a riser inclination sensor, and wherein the control system is linked to the riser inclination sensor to automatically actuate the riser disconnect only if an inclination of the riser does not exceed a maximum inclination.

4. The apparatus according to claim 1, wherein the sensors comprises:

a return flow rate sensor adapted to be coupled to a fluid return conduit of the drilling rig;

an upward flowing fluid temperature sensor adapted to be coupled to the wellhead assembly; and a wellhead bore pressure sensor adapted to be coupled to the wellhead assembly.

5. The apparatus according to claim 1, wherein at least one of the sensors comprises:

an inflow rate sensor adapted to be coupled to an input fluid conduit of the drilling rig.

6. The apparatus according to claim 1, wherein at least one of the sensors comprises:

a string weight sensor adapted to be coupled to a top drive of the drilling rig.

7. The apparatus according to claim 1, wherein at least one of the sensors comprises:

a rate of penetration sensor adapted to be coupled to a top drive of the drilling rig.

8. The apparatus according to claim 1, wherein at least one of the sensors comprises:

a torque sensor adapted to be coupled to the top drive of the drilling rig.

9. An apparatus providing for automatic detection and control of a kick during a subsea well drilling and completion operation with a rig connected to a subsea wellhead assembly via a riser and blowout preventer (BOP) having a riser disconnect that disconnects the riser from the BOP, the apparatus comprising:

a plurality of sensors, including a pressure sensor adapted to be coupled to the wellhead assembly and a return flow rate sensor adapted to be coupled to a fluid return conduit of the drilling rig;

a control system having a processor having a database with known ranges of wellhead pressure and return flow rates indicative of a kick event, the processor having means for receiving and comparing signal values from the pressure sensor and the return flow rate sensor against the known ranges and providing a warning to operating personnel in in the event a kick event is detected;

the control system being linked to the BOP and having means for closing the BOP automatically around a drill string extending through the riser in response to indications by the processor that the kick event is still occurring selected time period after the warning is provided;

the control sytem further means for closing a shear rams of the BOP to shear the drill string extending through the riser in the event the processor indicates the kick event is still occurring a selected time period after the BOP closed; and the control system further having means for actuating the riser disconnect to disconnect the riser from the BOP in the event the processor indicates the kick event is still occurring a selected time period after the drill string has been sheared.

10. The apparatus according to claim 9, wherein the sensors further comprise:

a riser inclination sensor linked to the processor; and wherein the control system actuate the riser disconnect only in the event the riser inclination sensed by the processor is less than a maximum riser inclination.

11. The apparatus according to claim 9, wherein the sensors further comprise:

an upward flowing fluid temperature sensor adapted to be coupled to the wellhead assembly;

an inflow rate sensor adapted to be coupled to an input fluid conduit of the drilling rig; and the control system receives a signal from the upward flowing fluid temperature sensor and the inflow rate sensor for processing.

12. The apparatus according to claim 9, wherein the sensors further comprise:

a string weight sensor adapted to be coupled to a top drive of the drilling rig;

a rate of penetration sensor adapted to be coupled to a top drive of the drilling rig;

a torque sensor adapted to be coupled to the top drive of the drilling rig; and the control system receives a signal from the string weight sensor, the rate of penetration sensor, and the torque sensor for processing.

13. A method for providing automatic detection and control of a kick during subsea well drilling and completion operations with a rig connected to a subsea wellhead assembly via a riser and blowout preventer (BOP), comprising:

coupling sensors to the wellhead assembly and various components of the rig to indicate conditions within the well;

providing a control system with a database of known sensor values that may be indicative of a pressure kick, and linking the control system to the sensors;

with the control system, determining the existence of a kick event by comparing the known sensor values to current sensor values received from the sensors;

automatically alerting operations personnel when a kick event is detected; then with the control system,continuing to determine wheather the kick event is still occurring for a selected time period, then if so, automatically closing the BOP with the control system to control the kick; then with the control system, continuing to determine whether the kick event is still occurring for a a selected time period after closing the BOP, and, if so, automatically taking steps to disconnect the riser from the BOP with the control system.

14. The method according to claim 13, wherein:

automatically taking steps to disconnect the riser from the BOP comprises automatically closing shear rams of the BOP around a drill string extending through the riser and BOP into the well; then with the control system automatically shearing the drill string with the shear rams, alerting operation personnel that the drill string has been sheared and continuing to determine whether the the kick event is still occurring.

15. The method according to claim 13, wherein:

automatically taking steps to disconnect the riser from the BOP comprises automatically closing shear rams of the BOP around a drill string extending through the riser and BOP into the well; then with the control system, automatically shearing the drill string with the shear rams, alerting operation personnel that the drill string has been sheared and continuing to determine whether the kick event is still occurring; then if the conrol system determine the kick event is still occurring after a selected time period, with the contol system, automatically disconnecting the riser string from the BOP.

16. The method according to claim 13, wherein:

coupling sensors to the wellhead assembly and various components of the rig comprises coupling a pressure sensor to the wellhead assembly.

17. The method according to claim 13, wherein:

coupling sensors to the wellhead assembly and various components of the drilling rig comprises coupling a return flow rate sensor to a fluid return conduit of the drilling rig.

18. The method according to claim 13, wherein:

coupling sensors to the wellhead assembly and various components of the drilling rig comprises coupling a return flow rate sensor to a fluid return conduit of the drilling rig and an inflow rate sensor to an input fluid conduit of the drilling rig.

19. The method according to claim 13, wherein:

coupling sensors to the wellhead assembly and various components of the drilling rig comprises coupling a string weight sensor, a rate of penetration sensor, and a torque sensor to a top drive of the drilling rig.

20. The method according to claim 15, wherein:

coupling sensors to the wellhead assembly and various components of the drilling rig comprises coupling a riser inclination sensor to the drilling rig; and wherein the control system automatically disconnects the riser from the BOP only if an inclination of the riser does not exceed a maximum inclination.

* * * * *